US008192128B2

(12) United States Patent
Orgeron

(10) Patent No.: US 8,192,128 B2
(45) **Date of Patent: *Jun. 5, 2012**

(54) ALIGNMENT APPARATUS AND METHOD FOR A BOOM OF A PIPE HANDLING SYSTEM

(75) Inventor: Keith J. Orgeron, Houston, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 380 days.

This patent is subject to a terminal disclaimer.

(21) Appl. No.: 12/469,598

(22) Filed: May 20, 2009

(65) Prior Publication Data

US 2010/0296899 A1 Nov. 25, 2010

(51) Int. Cl.
*E21B 19/00* (2006.01)
*B66C 23/06* (2006.01)
*E02F 3/00* (2006.01)

(52) U.S. Cl. ..... 414/22.55; 52/149; 212/255; 901/48

(58) Field of Classification Search ..... 166/77.52, 166/77.53; 175/85; 294/81.61; 414/22.55, 414/22.62, 23, 546, 680, 701, 729, 736, 738, 414/740, 742, 746.8, 776, 783; 52/119, 120, 52/146, 148; 74/103, 110, 490.01, 490.05, 74/63, 66, 68; 901/15, 16, 21, 22, 48
See application file for complete search history.

(56) References Cited

U.S. PATENT DOCUMENTS 62,404 A 2/1867 Gile et al.
184,168 A 11/1876 Nickle
364,077 A 5/1887 Addis
514,715 A 2/1894 Jenkins
1,175,792 A 3/1916 Mickelsen
1,249,194 A 12/1917 Race
1,264,867 A 4/1918 Schuh
1,312,009 A 8/1919 Thrift
1,318,789 A 10/1919 Moschel
(Continued)

FOREIGN PATENT DOCUMENTS

EP 0024433 A1 3/1981
(Continued)

OTHER PUBLICATIONS

U.S. Appl. No. 11/923,451, filed Oct. 24, 2007, Orgeron.
(Continued)

*Primary Examiner* — Gregory Adams
(74) *Attorney, Agent, or Firm* — John G. Fischer, Esq.; Paul D. Lein, Esq.; Scheef & Stone, L.L.P.

(57) ABSTRACT

A pipe handling apparatus has a frame, a boom pivotally connected to the frame so as to be movable between a first position and a second position, an arm extending outwardly of the boom when the boom is in the second position, a gripper affixed to the end of the arm opposite the boom, a first line having a first end affixed to the boom, a second line interconnected to an opposite end of the first line and connected to the frame, and an actuator interconnected to the first and second lines. The actuator changes an angular relationship of the first and second lines so as to selectively tension the lines. The second line includes a first cable offset from linear alignment with the first line and a second cable extending in angular relationship with the first cable.

18 Claims, 5 Drawing Sheets

U.S. PATENT DOCUMENTS 1,396,317 A 11/1921 Boyter
1,417,490 A 5/1922 Brandon
1,972,635 A 9/1934 Whinnen
1,981,304 A 11/1934 Brandt
2,124,154 A 7/1937 Sovincz
2,327,461 A 8/1943 Rowe
2,369,534 A * 2/1945 Cohen ..... 52/123.1
2,382,767 A 8/1945 Zeilman
2,476,210 A * 7/1949 Moore ..... 52/119
2,497,083 A 2/1950 Hildebrand
2,509,853 A 5/1950 Wilson
2,535,054 A 12/1950 Ernst
2,592,168 A 8/1952 Morris et al.
2,715,014 A 8/1955 Garnett et al.
2,770,493 A 11/1956 Fieber
2,814,396 A 11/1957 Neal, Sr.
2,828,024 A 3/1958 True
2,937,726 A * 5/1960 Manfred et al. ..... 52/114
3,033,529 A 5/1962 Pierrat
3,059,905 A 10/1962 Tompkin et al.
3,177,944 A 4/1965 Knights
3,194,313 A 7/1965 Fanshawe
3,262,593 A 7/1966 Hainer
3,280,920 A 10/1966 Scott
3,331,585 A 7/1967 Dubberke
3,365,762 A 1/1968 Spiri
3,464,507 A 9/1969 Alexander et al.
3,561,811 A 2/1971 Turner, Jr.
3,633,771 A 1/1972 Woolslayer
3,702,640 A 11/1972 Cintract
3,703,968 A 11/1972 Uhrich et al.
3,774,781 A 11/1973 Merkley
3,805,463 A * 4/1974 Lang et al. ..... 52/116
3,806,021 A 4/1974 Moroz et al.
3,823,916 A 7/1974 Shaw
3,848,850 A 11/1974 Bemis
3,860,122 A 1/1975 Cernosek
3,883,009 A 5/1975 Swoboda et al.
3,963,133 A * 6/1976 Gilli ..... 414/719
3,986,619 A 10/1976 Woolslayer et al.
3,991,887 A 11/1976 Trout
3,995,746 A 12/1976 Usagida
4,011,694 A 3/1977 Langford
4,030,698 A 6/1977 Hansen
4,044,952 A 8/1977 Williams et al.
4,158,283 A 6/1979 Nation
4,172,684 A 10/1979 Jenkins
4,269,554 A 5/1981 Jackson
4,276,918 A 7/1981 Sigouin
4,303,270 A 12/1981 Adair
4,336,840 A 6/1982 Bailey
4,403,666 A 9/1983 Willis
4,403,897 A 9/1983 Willis
4,407,629 A 10/1983 Willis
4,420,917 A 12/1983 Parlanti
4,440,536 A 4/1984 Scaggs
4,492,501 A 1/1985 Haney
4,529,094 A 7/1985 Wadsworth
4,595,066 A 6/1986 Nelmark et al.
4,650,237 A 3/1987 Lessway
4,708,581 A 11/1987 Adair
4,759,414 A 7/1988 Willis
4,765,401 A 8/1988 Boyadjieff
4,822,230 A 4/1989 Slettedal
4,834,604 A 5/1989 Brittain et al.
4,869,137 A 9/1989 Slator
4,982,853 A 1/1991 Kishi
5,060,762 A 10/1991 White
5,135,119 A 8/1992 Larkin
5,186,264 A 2/1993 du Chaffaut
5,415,057 A 5/1995 Nihei et al.
5,458,454 A 10/1995 Sorokan
5,597,987 A 1/1997 Gilliland et al.
5,609,226 A 3/1997 Penisson
5,649,745 A 7/1997 Anderson
5,660,087 A 8/1997 Rae
5,671,932 A 9/1997 Chapman
5,806,589 A 9/1998 Lang
5,848,647 A 12/1998 Webre et al.
5,931,238 A 8/1999 Gilmore et al.
5,934,028 A * 8/1999 Taylor ..... 52/167.3
5,964,550 A 10/1999 Blandford et al.
5,992,801 A 11/1999 Torres
5,993,140 A 11/1999 Crippa
6,003,598 A 12/1999 Andreychuk
6,158,516 A 12/2000 Smith et al.
6,220,807 B1 4/2001 Sorokan
6,227,587 B1 5/2001 Terral
6,234,253 B1 5/2001 Dallas
6,253,845 B1 7/2001 Belik
6,263,763 B1 7/2001 Feigel, Jr. et al.
6,264,128 B1 7/2001 Shampine et al.
6,264,395 B1 7/2001 Allamon et al.
6,279,662 B1 8/2001 Sonnier
6,311,788 B1 11/2001 Weixler
6,343,892 B1 2/2002 Kristiansen
6,398,186 B1 6/2002 Lemoine
6,431,286 B1 8/2002 Andreychuk
6,471,439 B2 10/2002 Allamon et al.
6,502,641 B1 1/2003 Carriere et al.
6,543,551 B1 4/2003 Sparks et al.
6,543,555 B2 4/2003 Casagrande
6,557,641 B2 5/2003 Sipos et al.
6,581,698 B1 6/2003 Dirks
6,609,573 B1 8/2003 Day
6,705,414 B2 3/2004 Simpson et al.
6,745,646 B1 6/2004 Pietras et al.
6,748,823 B2 6/2004 Pietras
6,763,898 B1 7/2004 Roodenburg et al.
6,779,614 B2 8/2004 Oser
6,814,149 B2 11/2004 Liess et al.
6,845,814 B2 1/2005 Mason et al.
7,017,450 B2 3/2006 Bangert
7,028,585 B2 4/2006 Pietras et al.
7,044,315 B2 5/2006 Willim
7,055,594 B1 6/2006 Springett et al.
7,077,209 B2 7/2006 McCulloch
7,090,035 B2 8/2006 Lesko
7,090,254 B1 8/2006 Pietras et al.
7,117,938 B2 10/2006 Hamilton et al.
7,121,166 B2 10/2006 Drzewiecki
7,172,038 B2 2/2007 Terry et al.
7,289,871 B2 10/2007 Williams
7,296,623 B2 11/2007 Koithan et al.
7,398,833 B2 7/2008 Ramey et al.
7,438,127 B2 10/2008 Lesko
7,503,394 B2 3/2009 Bouligny
7,726,929 B1 * 6/2010 Orgeron ..... 414/22.55
7,946,795 B2 5/2011 Orgeron
7,980,802 B2 7/2011 Orgeron
8,011,426 B1 9/2011 Orgeron
2002/0070187 A1 * 6/2002 Willim ..... 212/299
2003/0221871 A1 12/2003 Hamilton et al.
2006/0151215 A1 7/2006 Skogerbo
2008/0023432 A1 * 1/2008 Paschke ..... 212/298
2008/0078965 A1 4/2008 Lane et al.
2008/0174131 A1 7/2008 Bouligny et al.
2008/0202812 A1 8/2008 Childers et al.
2008/0253866 A1 10/2008 Lops et al.
2009/0232624 A1 9/2009 Orgeron
2010/0032213 A1 * 2/2010 Orgeron ..... 175/85
2010/0034619 A1 2/2010 Orgeron
2010/0187740 A1 7/2010 Orgeron
2010/0230166 A1 9/2010 Sigmar et al.
2010/0254784 A1 10/2010 Orgeron et al.
2010/0296899 A1 * 11/2010 Orgeron ..... 414/22.55
2011/0030942 A1 2/2011 Orgeron
2011/0200412 A1 8/2011 Orgeron

FOREIGN PATENT DOCUMENTS

GB 2264736 A 9/1993
JP 2001287127 A 10/2001
WO 1993015303 A1 8/1993
WO WO 2006038790 A1 * 4/2006

OTHER PUBLICATIONS

U.S. Appl. No. 12/111,907, filed Apr. 29, 2008; non-published; titled "Pipe Gripping Apparatus" and having common inventors with the present patent application.

U.S. Appl. No. 12/371,590, filed Feb. 14, 2009; non-published; titled "Tubular Gripping Apparatus" and having common inventors with the present patent application.

U.S. Appl. No. 12/371,593, filed Feb. 14, 2009; non-published; titled "Pipe Handling Apparatus With Stab Frame Stiffening" and having common inventors with the present patent application.

U.S. Appl. No. 12/632,261, filed Dec. 7, 2009; non-published; titled "Stabbing Apparatus and Method" and having common inventors with the present patent application.

U.S. Appl. No. 12/633,891, filed Dec. 9, 2009; non-published; titled "Stabbing Apparatus for Centering Tubulars and Casings for Connection at a Wellhead" and having common inventors with the present patent application.

U.S. Appl. No. 12/633,913, filed Dec. 9, 2009; non-published; titled "Apparatus for a Pipe Tong and Spinner Deployment" and having common inventors with the present patent application.

U.S. Appl. No. 12/789,332, filed May 27, 2010; non-published; titled "Pipe Handling Boom Pretensioning Appratus" and having common inventors with the present patent application.

U.S. Appl. No. 13/114,842, filed May 24, 2011; non-published; titled "Telescoping Jack for a Gripper Assembly" and having common inventors with the present patent application.

U.S. Appl. No. 13/226,343, filed Sep. 6, 2011; non-published; titled "Method of Gripping a Tubular With a Tubular Gripping Mechanism" and having common inventors with the present patent application.

U.S. Appl. No. 13/335,794, filed Dec. 22, 2011; not yet published; titled "Fast Transportable Drilling Rig System" and having common inventors with the present patent application.

Chronis, Nicholas P.; Mechanisms & Mechanical Devices Sourcebook, 1991, Ch. 10, pp. 399-414, ISBN 0-07-010918-4, McGraw-Hill, Inc.

* cited by examiner

ALIGNMENT APPARATUS AND METHOD FOR A BOOM OF A PIPE HANDLING SYSTEM

BACKGROUND OF THE INVENTION

1. Field of the Invention

The present invention relates to the handling of tubulars from a horizontal orientation to a vertical orientation. Particularly, the present invention relates to a pipe handling apparatus that positions tubulars in a wellhead. More particularly, the present invention relates to apparatus for adjusting a position of a boom of the pipe handling apparatus when positioning tubulars at a wellhead.

2. Description of Related Art Including Information Disclosed Under 37 CFR 1.97 and 37 CFR 1.98

Drill rigs have utilized several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the wellhead. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

In the past, various devices have been created which mechanically move a pipe from a horizontal orientation to a vertical orientation such that the vertically-oriented pipe can be installed into the well bore. Typically, these devices have utilized several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary so as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

To address these problems and needs, U.S. application Ser. No. 11/923,451, filed on Oct. 24, 2007 by the present applicant, discloses a pipe handling system that has a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion.

The pipe handling system delivers a pipe to a wellhead when in the second position. Pipes can be of extraordinary lengths and weights. The boom of the above pipe handling system is pivotally connected to a skid so as to pivot between the first and second positions. Pipes can be of extraordinary lengths and weights; therefore, the pivotal connection between the boom and skid must be strong so as to withstand the forces created by the movement of the boom between the first and second positions. Typically, hydraulic cylinders are placed between the boom and skid so as to raise and lower the boom between the first and second positions. The hydraulic cylinders are connected to a hydraulic power system so as to raise and lower the boom between the first and second positions.

Various patents have issued relating to the movement of a boom of a pipe handling system with hydraulic cylinders or other similar means. For example, U.S. Pat. No. 7,077,209, issued on Jul. 18, 2006 to McCulloch et al., discloses a mast for lifting and suspending a coiled tubing injector and blowout preventer over a wellhead that is pivotally mounted on a rear portion of a truck. The mast has two side-by-side telescoping legs that extend and retract synchronously. Hydraulic cylinders pivotally move the mast between a lower position and an upper position.

U.S. Pat. No. 4,336,840, issued on Jun. 29, 1982 to Bailey, discloses a suspension system for use with a mast. The system has two or more fluid pressure piston-and-cylinder assemblies. The cylinders are linked in pairs so that retraction of both piston rods reduces the length of the pair of assemblies to the length of a single assembly. Operation of both pistons in a pair provides an effective stroke twice the length of a single assembly stroke. In a particular embodiment, a double-cylinder system is used as a pickup system for elevating equipment along a mast in a well work over rig.

U.S. Pat. No. 7,289,871, issued on Oct. 30, 2007 to Williams, discloses a drilling apparatus that has a base from which a drilling arm is pivotally mounted. The drilling arm has an inner arm and an outer arm. The inner arm has a first end and a second end. The first end is pivotally connected by a first pivot joint to the base. The outer arm has a first end and a second end. The second end of the inner arm is pivotally connected via a second pivot joint to the first end of the outer arm. A drill-mounting assembly is positioned at the second end of the outer arm. Actuation of the inner and outer arms is achieved by hydraulic cylinders. Proper operation of the cylinders causes the second end of the outer arm to follow a substantially linear path.

U.S. Pat. No. 6,003,598, issued on Dec. 21, 1999 to Andreychuk, discloses a mobile hybrid rig adapted to run coiled tubing and wireline equipment for oil and gas wells. The rig has a chassis and power unit for transporting the rig. An adjustable platform with a number of hydraulically-operated stabilizers aligns the tubing at the wellhead. A mast is pivotable into slanted or vertical positions for coil tubing operation with a blowout preventer and an injector. A cradle supports and aligns an injector to the wellhead. A coil-tubing reel cartridge assembly is adapted to run coil-tubing reels. A winching facility is used to manipulate wireline equipment. A control cabin is used to manage rig activities.

U.S. Pat. No. 6,234,253, issued on May 22, 2001 to Dallas, discloses a method and apparatus for servicing a well. The apparatus has a pair of hydraulic cylinders pivotally mounted to a pair of base beams. The cylinders are movable from a horizontal position for transportation to a vertical position for operation. In the vertical position, the cylinders flank a wellhead and are adapted to lift the wellhead and attached production tubing using a workover beam and a lifting sub. The wellhead and production tubing can be rotated during or after elevation. A motor can be mounted to the workover beam to rotate the wellhead and the tubing. A calibrated pressure gauge can be used to indicate the weight being lifted. The apparatus can be connected to a crane truck.

U.S. Pat. No. 6,264,128, issued on Jul. 24, 2001 to Shampine et al., discloses a levelwind system for a coiled-tubing reel that has an arcuate guide arm extending over the upper surface of the reel, a universal joint mounted to the lower end of the arm, a guide member supported on the free end of the guide arm, a lift cylinder for raising and lowering the guide arm, a balancing cylinder for moving the guide arm laterally, and a hydraulic fluid circuit that is responsive to a position sensor and a microprocessor.

U.S. Pat. No. 6,431,286, issued on Aug. 13, 2002 to Andreychuk, discloses an injector arrangement for use in a rig that has a movable carrier, a derrick tiltably mounted to the carrier, and a trolley capable of sliding along the derrick. An injector cradle is movable along the trolley in at least a plane perpendicular to the derrick and is pivotally mountable beneath the trolley. An injector is supported at its upper end from the cradle. At least two hydraulic cylinders are supported at one end by the derrick. The cylinders are engaged at an opposed end to a lower end of the injector.

In the pipe handling system of U.S. application Ser. No. 11/923,451, filed on Oct. 24, 2007, by the present applicant, it was found that fine adjustments of the boom could be necessary so as to precisely align the pipe with the wellhead. Also, it was found desirable to properly tension the boom during movement of the boom between the stowed position to the deployed position.

It is an object of the present invention to provide an alignment device for a boom that provides fine adjustments to the boom and the associated pipe.

It is another object of the present invention to provide an alignment device that can selectively tension the boom during movement and positioning of the boom.

It is another object of the present invention to provide an alignment device that can be easily applied to the boom and easily operated.

It is still another object of the present invention to provide an alignment device that can be remotely operated and automatically controlled.

These and other objects and advantages of the present invention will become apparent from a reading of the attached specification and appended claims.

BRIEF SUMMARY OF THE INVENTION

The present invention is an alignment apparatus for a boom of a pipe handling device having a first line with a first end suitable for connection to the boom, a second line having an end connected to the first line, and an actuator means interconnected to at least one of the first and second lines for changing an angular relationship between the first and second lines. A connector member is connected to an end of the first line and to the end of the second line. The actuator means is cooperative with the connector member. In the preferred embodiment of the present invention, the connector member is a ring.

The second line has an opposite end suitable for connection to a fixed surface away from the boom. In particular, the second line includes a first cable offset from linear alignment with the first line and a second cable extending in angular relationship to the first cable.

The actuator means comprises a hydraulic piston-and-cylinder assembly having one end affixed to a fixed surface and an opposite end interconnected to the first and second lines. The hydraulic actuator extends in angularly offset relationship to the first and second lines. This actuator means is movable between a first position in which the first and second lines are untensioned and a second position in which first and second lines are tensioned.

The present invention is also a pipe handling device that comprises a frame, a boom pivotally connected to the frame so as to be movable between a first position and a second position, an arm extending outwardly of the boom when the boom is in the second position, a first line having a first end affixed to the boom, a second line interconnected to an opposite end of the first line and interconnected to the frame, and an actuator means interconnected to the first and second lines. The actuator means serves to change an angular relationship of the first and second lines so as to selectively tension the first and second lines. The arm has a gripper at an end thereof opposite the boom so as to receive a tubular therein.

In the present invention, the second line includes a first cable offset from linear alignment with the first line and a second cable extending in angular relationship with the first cable. Each of the first and second cables has an end affixed to the frame. A connector member is affixed to an opposite end of the first and second cables. The opposite end of the first line is connected to the connector member. The actuator means is connected to the connector member. The first cable extends in an inverted V-shaped orientation relative to the second cable. The actuator means includes a piston-and-cylinder assembly having one end connected to the frame and an opposite end interconnected to the first and second lines. The piston-and-cylinder assembly extends in angularly offset relationship to the first and second lines. The piston-and-cylinder assembly is movable between a first position in which the first and second lines are untensioned and the second position in which the first and second lines are tensioned.

The boom has a first end pivotally connected to the frame. The arm is pivotally connected to an opposite end of the boom. The first end of the first line is affixed to the boom between the first and second ends of the boom. A hydraulic actuator has an end connected to the frame and an opposite end connected to the boom. The hydraulic actuator is suitable for moving the boom between the first and second positions. The first and second lines of the actuator means are positioned on an opposite side of the boom from the hydraulic actuator. The piston-and-cylinder assembly has a piston rod with an end connected to the connector member and a cylinder having an end opposite the piston rod connected to the frame. A lever member is pivotally connected to an end of the boom opposite the frame. The arm is pivotally connected to the lever member. A link has one end pivotally connected to the frame and an opposite end pivotally connected to an end of the lever member opposite the arm. The gripper is affixed to the end of the arm opposite the lever member.

DETAILED DESCRIPTION OF THE INVENTION

Figure 1:
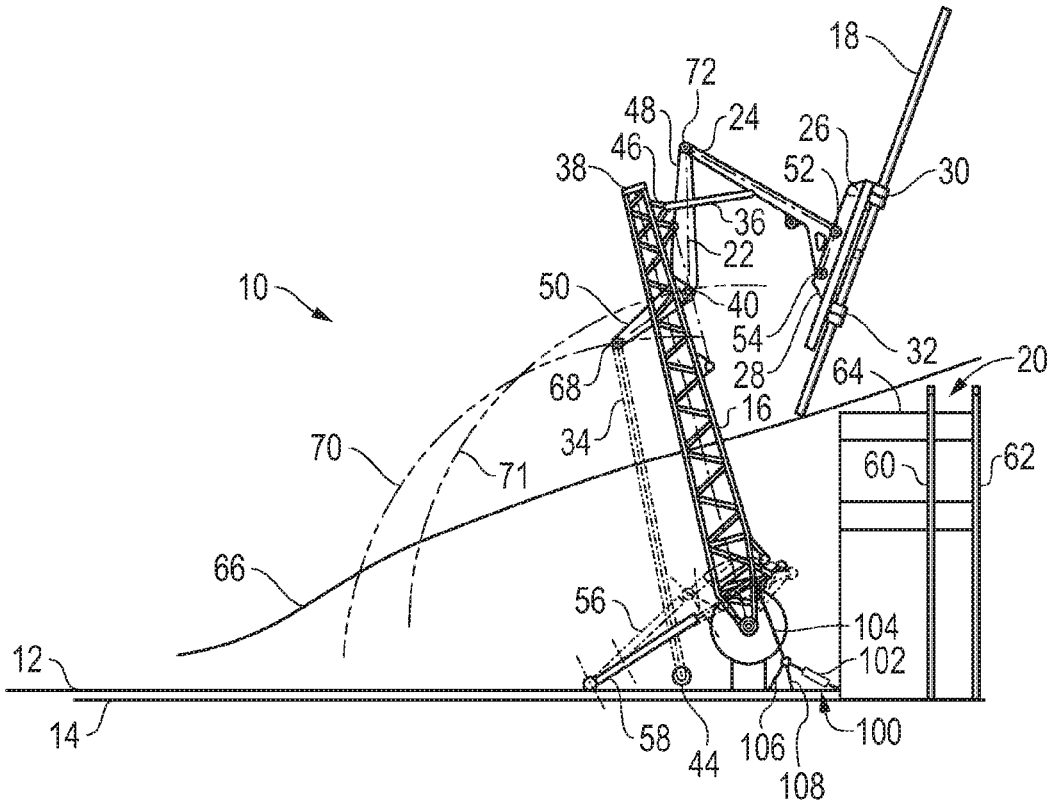
FIG. 1 shows a side elevational view of the preferred embodiment of the apparatus of the present invention as used on a pipe handling system.

Referring to FIG. 1, there is shown a side elevational view of the preferred embodiment of the apparatus 100 of the present invention as used with a pipe handling system 10. The pipe handling system 10 is mounted on a frame 12 (such as a skid) that can be supported upon the bed 14 of a vehicle, such as a truck. The pipe handling system 10 includes a boom 16 that is pivotally movable between a first position and a second position relative to a frame 12. In FIG. 1, an intermediate position of the pipe handling system 10 is particularly shown. In this position, the pipe 18 is illustrated in its position prior to installation on the drill rig 20. A lever assembly 22 is pivotally connected to the boom 16. An arm 24 is pivotally connected to an end of the lever assembly 22 opposite the boom 16. A gripper assembly 26 is fixedly connected to an opposite end of the arm 24 opposite the lever assembly 22. The gripper assembly 26 includes a stab frame 28 and grippers 30 and 32. A link 34 has one end pivotally connected to the frame 12 and an opposite end pivotally connected to the end of the lever assembly 22 opposite the arm 24. A brace 36 is pivotally connected to a small frame member 46 of the boom 16 and also pivotally connected to the arm 24 between the lever assembly 22 and the stab frame 28 of gripper assembly 26.

Figure 6:
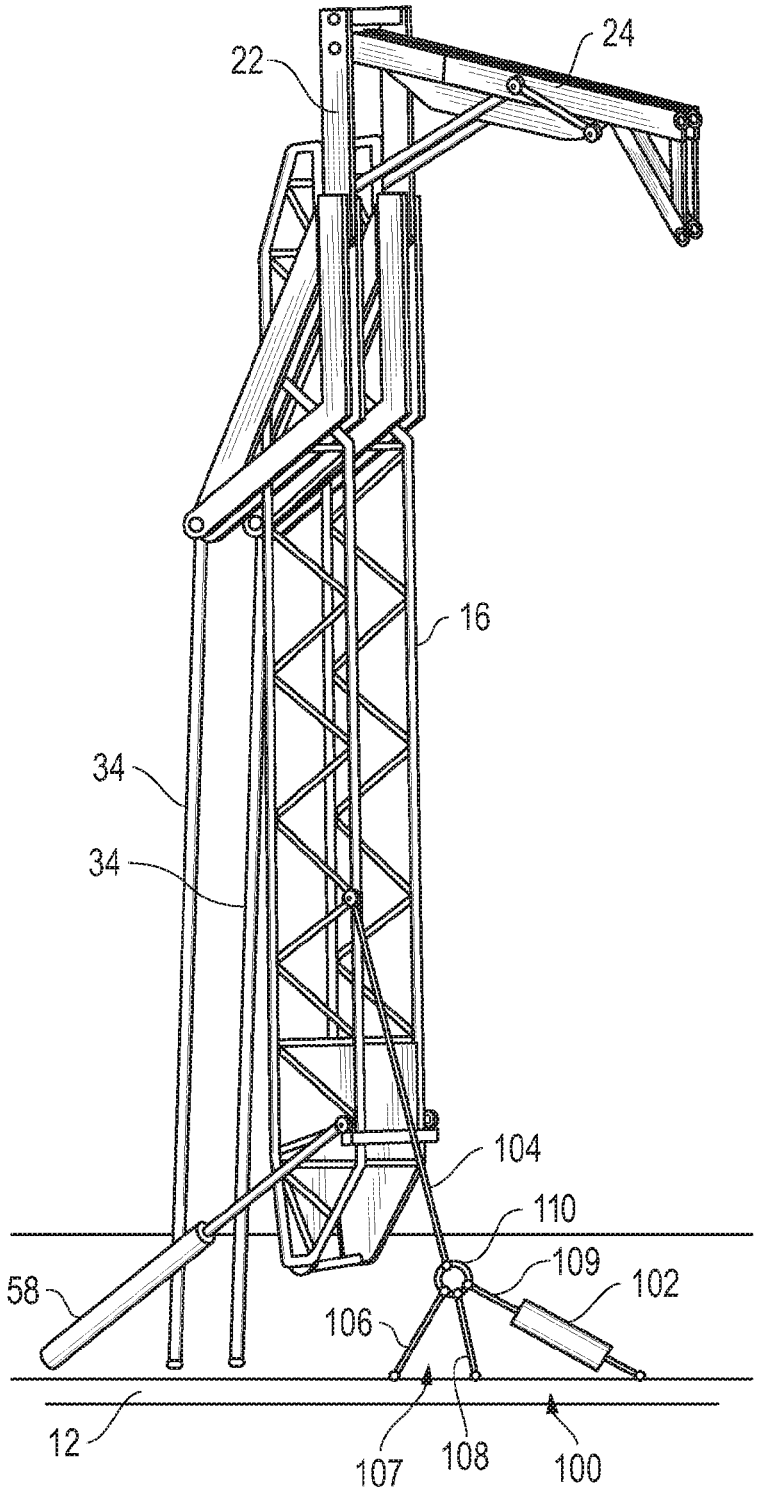
FIG. 6 shows an isolated perspective view of the preferred embodiment of the apparatus of the present invention attached to the boom of the pipe handling system.

Referring momentarily to FIG. 6, the preferred embodiment of the apparatus 100 of the present invention has a first line 104 connected to the boom 16 of the pipe handling system 10. A second line arrangement 107 is connected to an end of the first line 104 opposite the boom 16. The second line arrangement 107 has a first cable 106 connected to the first line 104. A second cable 108 is connected to the first line 104. An actuator 102 is connected to the first line 104. An end of the actuator 102 opposite the first line 104 is connected to the frame 12. An end of the second cable 108 opposite the first line 104 is connected to the frame 12. An end of the first cable 106 opposite the first line 104 is connected to the frame 12. The first cable 106 is connected to the first line 104 by a connector member, such as junction ring 110. The second cable 108 is connected to the first line 104 by the junction ring 110. The actuator 102 is connected to the first line 104 by junction ring 110. The first line 104, the first cable 106, the second cable 108, and the actuator 102 are of appropriate lengths so that the apparatus 100 is tensioned when the boom 16 is in the second position. The actuator 102 may be a hydraulic cylinder, a screw or a turnbuckle. In FIG. 6, the actuator 102 is a hydraulic cylinder. The hydraulic cylinder can be actuated so as to move a piston rod inwardly or outwardly of the cylinder. The actuator 102 varies the alignment of the boom 16 so as to vary the alignment of a pipe held by the boom 16, and the pipe handling system 10, over a wellhead. The apparatus 100 can finely adjust the position of the boom 16. For example, if the apparatus 100 is positioned to a side of the boom 16, then the apparatus 100 would align the boom laterally with respect to the wellhead. If the apparatus 100 were positioned in front or behind the boom 16, then the boom would be aligned forward or backward of the wellhead. Thusly, the apparatus 100 may apply a tension to the boom 16, and may cause forward, backward and lateral movement to the boom 16.

Figure 2:
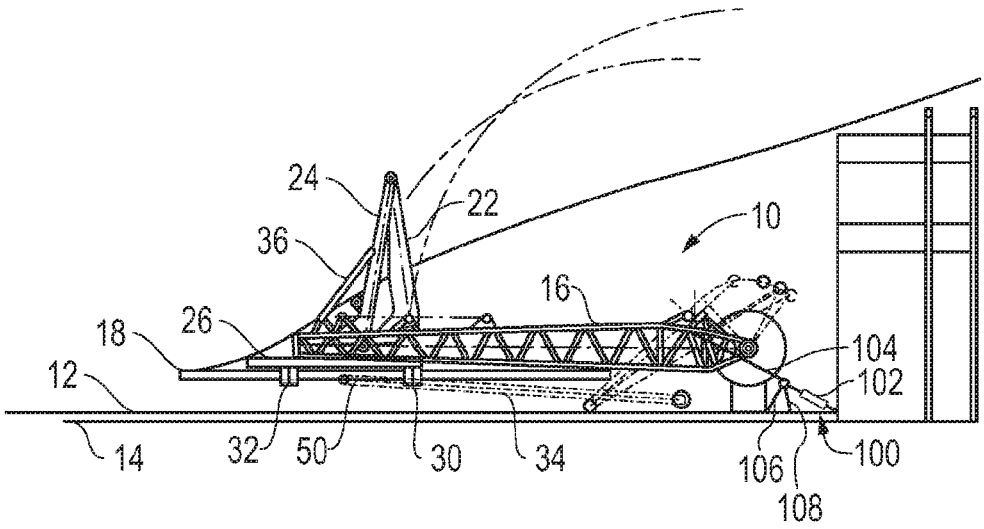
FIG. 2 shows a side elevational view of the preferred embodiment of the apparatus of the present invention as used on a pipe handling system, with the system in a first position.

FIG. 2 illustrates the drill pipe 18 in a generally horizontal orientation. In the present invention, it is important to note that the drill pipe can be delivered to the apparatus 10 in a position below the boom 16. In particular, the drill pipe can be loaded upon the frame 12 in a location generally adjacent to the grippers 30 and 32 associated with the gripper assembly 26. As such, the present invention facilitates the easy delivery of the drill pipe to the desired location. The grippers 30 and 32 will grip the outer diameter of the pipe 18 in this horizontal orientation.

In FIG. 2, it can be seen that the boom 16 resides above the drill pipe 18 and in generally parallel relationship to the top surface of the skid 12. The lever assembly 22 is suitably pivoted so that the arm 24 extends through the interior of the framework of the boom 16 and such that the gripper assembly 26 engages the pipe 18. The brace 36 resides in connection with the small frame member 46 of the boom 16 and also is pivotally connected to the arm 24. In this position, the link 34 will reside below the boom 16 generally adjacent to the upper surface of the skid 12 and is connected to the second portion 50 of the lever assembly 22 below the boom 16.

Figure 3:
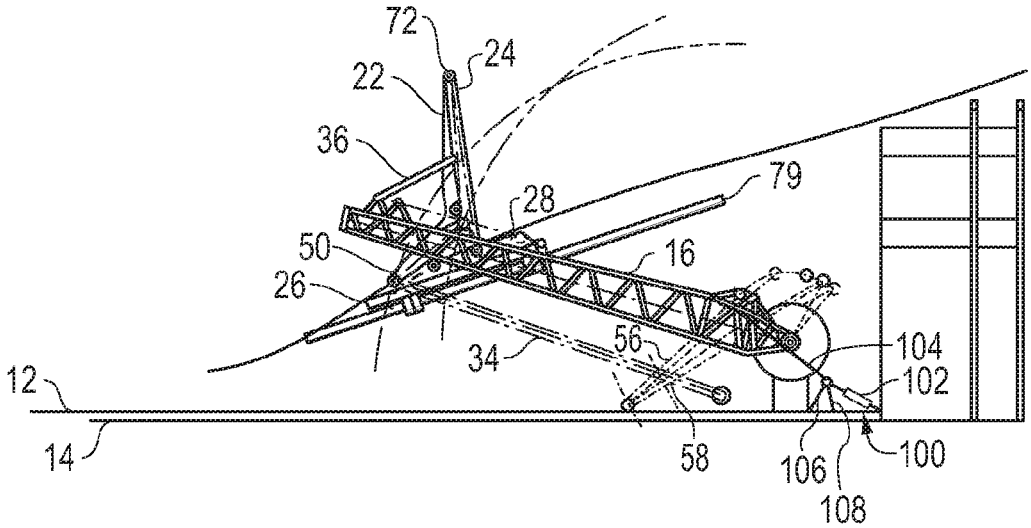
FIG. 3 shows a side elevational view of the apparatus of the present invention as used on the pipe handling system, with the pipe handling system moving from the first position toward a second position.

FIG. 3 shows an intermediate position of the drill pipe 18 during the movement from the horizontal orientation to the vertical orientation. As can be seen, the gripper assembly 26 has engaged with the pipe 18. The lever assembly 22 is pivoting so that the top end 79 of pipe 18 will pass through the interior of the framework of the boom 16. Also, the arm 24 associated with the gripper assembly 26 serves to move the stab frame 28 of the gripper assembly 26 through the interior of the framework of the boom 16. The brace 36 is pulling on the first portion 48 of lever assembly 22 so as cause this motion to occur. The link 34 is pulling on the end of the second portion 50 of the lever assembly 22 so as to draw the first portion 48 upwardly and to cause the movement of the body 28 of the gripper assembly 26. The hydraulic actuators 56 and 58 have been operated so as to urge the boom 16 pivotally upwardly.

Figure 4:
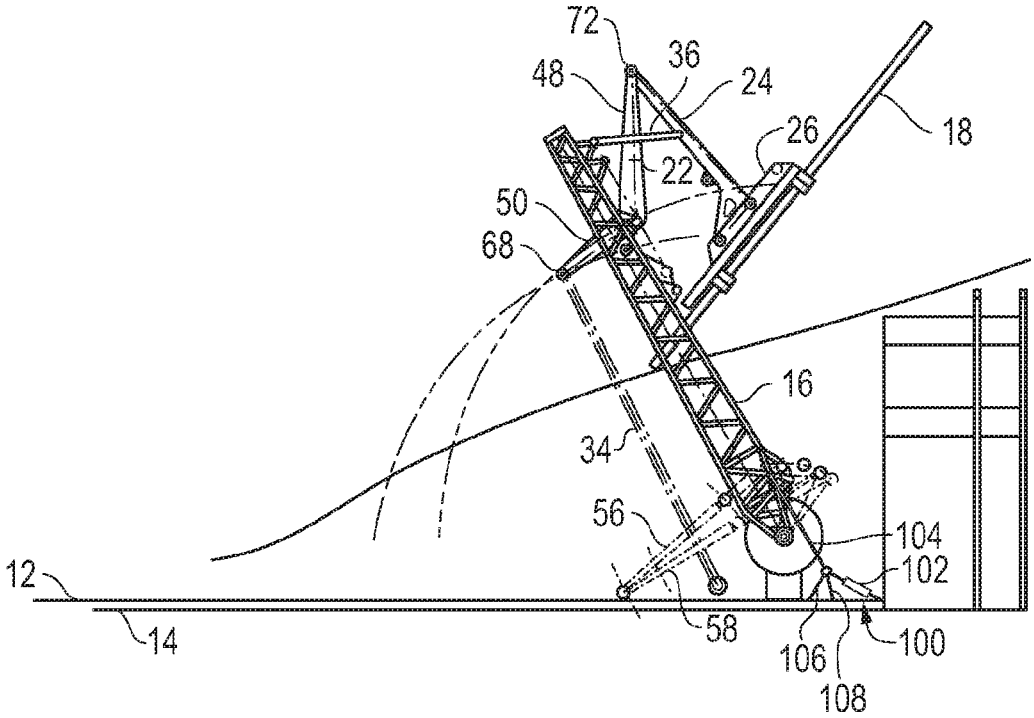
FIG. 4 shows a side elevational view of the apparatus of the present invention as used on a pipe handling system, with the pipe handling system moving further towards the second position.

FIG. 4 shows a further intermediate movement of the drill pipe 18. Once again, the hydraulic actuators 56 and 58 urge the boom 16 angularly upwardly away from the top surface of the frame 12. This causes the link 34 to have a pulling force on the pivotal connection 68 of the second portion 50 of the lever assembly 22. This causes the first portion 48 of the lever assembly 22 to move upwardly thereby causing the arm 24, in combination with the brace 36, to lift the gripper assembly 26 further upwardly and draw the pipe 18 completely through the interior of the boom 16. As can be seen, the relative size and relation of the various components of the present invention achieve the movement of the pipe 18 without the need for separate hydraulic actuators, apart from hydraulic actuators 56 and 58.

Figure 5:
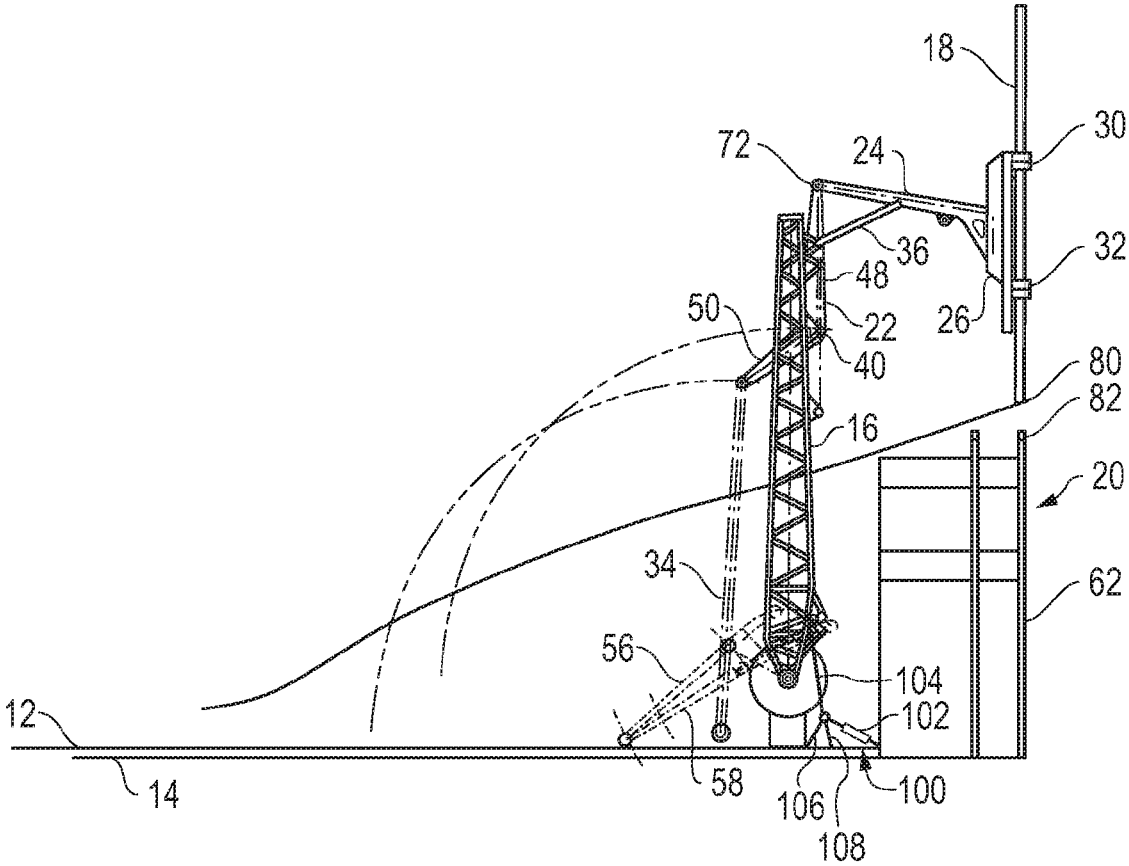
FIG. 5 shows a side elevational view of the apparatus of the present invention as used on a pipe handling system, with the pipe handling system in the second position.

FIG. 5 illustrates the drill pipe 18 in its vertical orientation. As can be seen, the drill pipe 18 is positioned directly above the underlying pipe 62 on the drilling rig 20. The further upward pivotal movement of the boom 16 is caused by the hydraulic cylinders 56 and 58. This causes the link 34 to rotate and draw the end of the second portion 50 of the lever assembly 22 downwardly. The lever assembly 22 rotates about the pivot point 40 such that the first portion 48 of the lever assembly 22 has a pivot 72 at an end of the first portion 48. The brace 36 is now rotated in a position so as to provide support for the arm 24 in this upper position. The gripper assembly 26 has grippers 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the present invention and without the need for complex control mechanisms and hydraulics.

In order to install the drill pipe 18 upon the pipe 62, it is only necessary to vertically translate the grippers 30 and 32 within the body 28 of the gripper assembly 26. As such, the end 80 can be stabbed into the box connection 82 of pipe 62. Suitable tongs, spinners, or other mechanisms can be utilized so as to rotate the pipe 18 in order to achieve a desired connection. The grippers 30 and 32 can then be released from the exterior of the pipe 18 and returned back to the original position such that another length of drill pipe can be installed.

Figure 7:
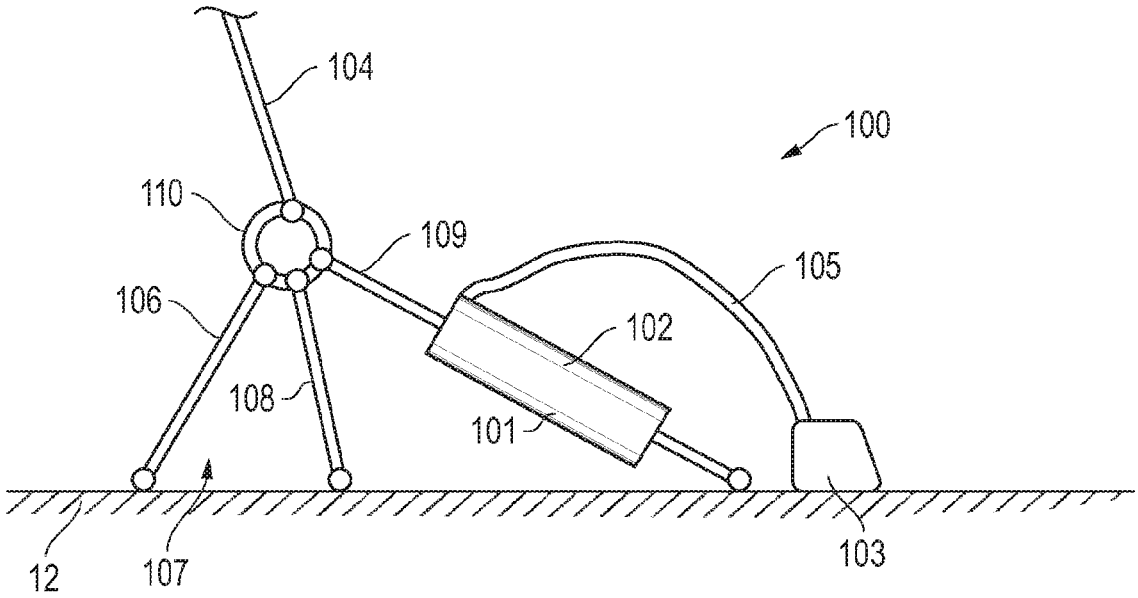
FIG. 7 shows a side elevational view of the preferred embodiment of the apparatus of the present invention.

Returning to FIG. 7, there is shown an isolated view of the preferred embodiment of the apparatus 100 of the present invention. In FIG. 7, the actuator 102 of the apparatus 100 may be a hydraulic cylinder 101. The hydraulic cylinder 101 may be connected to a hydraulic power supply 103. The hydraulic power supply 103 transfers hydraulic fluid to and from the hydraulic cylinder 101 via a hydraulic fluid line 105 so as to increase and decrease the length of the actuator 102.

In FIG. 7, it can be seen that the first line 104 is connected, at one end, to the junction ring 110. First cable 106 and second cable 108 each have one end fixedly connected to the frame 12 and an opposite end connected to the junction ring 110. The first cable 106 and the second cable 108 may extend in an inverted V-shaped angular relationship to each other. In a preferred embodiment, the actuator 102 may have a piston rod 109 that has an end connected to the junction ring 110. The actuator 102 has an opposite end connected to the frame 12. When the hydraulic power supply 103 introduces hydraulic fluid into the hydraulic cylinder 101 via the hydraulic fluid 105, the piston rod 109 can be pushed outwardly so as to change the angular relationship between the first line 104 and the first cable 106 and the second cable 108. When the piston rod 109 of the actuator 102 is pulled inwardly, a different angular orientation between the first line 104 and the first cable 106 and second cable 108 is achieved. In the position shown in FIG. 7, the relationship between the first line 104 and the first cable 106 and the second cable 108 is relatively untensioned. However, by the movement of the piston rod 109 of the actuator 102, along with the movement of the junction ring 110, the angular orientation can be changed so as to properly tension the first line 104, the first cable 106 and the second cable 108. As a result, by relatively small movements of the junction ring 110, the first line 104, the first cable 106 and the second cable 108, fine adjustments of the boom 16 may be achieved. As a result, the apparatus 100 may enable an operator to finely adjust the position of the tubular 18 as held by the grippers 30 and 32 of the pipe handling system 10. The apparatus 100 may also allow an operator to selectively tension the boom 16 of the pipe handling system 10.

Various techniques, such as laser measurement, can be utilized so as to properly orient the pipe 18 with the wellhead. In this manner, proper signals can be transmitted to the hydraulic power supply 103 so as to manipulate the actuator 102 for the fine adjustment of the boom 16.

The present invention also allows additional tension to be applied to the boom. In certain circumstances, the weight of the load carried by the grippers of the pipe handling apparatus may cause certain movements or deflections of the boom 16. By placing the first line 104, along with the first cable 106 and the second cable 108, into a properly tensioned condition, the boom 16 may achieve proper strength so as to avoid such deflections and movements. Additionally, through the use of the apparatus 100 of the present invention, the actual weight of the components of the pipe handling system 10 of the present invention may be reduced since proper tensioning can be achieved without the need for heavy structural components.

The foregoing disclosure and description of the invention is illustrative and explanatory thereof. Various changes in the details of the illustrated construction and method can be made without departing from the true spirit of the invention. The present invention should only be limited by the present specification and appended claims.

The invention claimed is:

1. A pipe handling device comprising:

a frame;

a boom pivotally connected to the frame, the boom movable between a first generally horizontal position and a second generally vertically position;

an arm extending outwardly of the boom when the boom is in the second position, the arm having a gripper at an end thereof opposite the boom;

a first line having a first end connected to the boom, and an opposite second end connected to a connector;

a first lower cable offset from linear alignment with the first line, and having a first end connected to the frame, and an opposite second end connected to the connector;

a second lower cable extending in angular relationship to the first lower cable, and having a first end connected to the frame, and an opposite second end connected to the connector;

an actuator having a first end connected to the frame, and an opposite second end connected to at least one of the first line, first lower cable and the connector;

the first line, first lower cable and actuator applying tension to the boom when the boom is in the second position;

the first line and second lower cable applying tension to the boom when the boom is in the first position; and the actuator being controllable to alter an angular relationship between the first line and the first lower cable to increase or decrease the tension on the boom when the boom is in the first position.

2. The pipe handling device of claim 1, the second end of the actuator connected to the connector.

3. The pipe handling apparatus of claim 1, the connector being ring.

4. The pipe handling apparatus of claim 1, the first lower cable extending in an inverted V-shaped orientation relative to the second lower cable.

5. The pipe handling apparatus of claim 1, the first lower cable connected to the frame at a point closest to the boom relative to the second lower cable and actuator.

6. The pipe handling apparatus of claim 1, the actuator connected to the frame at a point furthest from the boom relative to the first and second lower cables.

7. The pipe handling apparatus of claim 1, the actuator extending in angular relationship to the first line and first lower cable.

8. The pipe handling apparatus of claim 1, the actuator is selected from a group consisting of a hydraulic cylinder, a screw and a turnbuckle.

9. The pipe handling apparatus of claim 8, the actuator comprising a hydraulic piston-and-cylinder assembly.

10. The pipe handling apparatus of claim 9, wherein the hydraulic piston-and-cylinder assembly has a piston rod end connected to the connector, and a cylinder end connected to the frame.

11. The pipe handling apparatus of claim 1, the boom having a first end pivotally connected to the frame, the arm being pivotally connected to an opposite end of the boom, the first end of the first line being connected to the boom between the first and second ends of the boom.

12. The pipe handling apparatus of claim 1, further comprising:

a hydraulic actuator located behind the boom and having an end connected to the frame and an opposite end connected to the boom, the hydraulic actuator suitable for moving the boom between the first and second positions.

13. The pipe handling apparatus of claim 12, the first line, first lower cable and actuator positioned to a side of the boom with respect to the hydraulic actuator.

14. The pipe handling apparatus of claim 12, the first line, first lower cable and actuator positioned in front of the boom with respect to the hydraulic actuator.

15. The pipe handling apparatus of claim 1, further comprising:

a lever pivotally connected to an end of the boom opposite the frame, the arm being pivotally connected to the lever; and, a link having one end pivotally connected to the frame and an opposite end pivotally connected to an end of the lever member opposite the arm.

16. The pipe handling apparatus of claim 1 wherein the first line and second lower cable apply a tension to the boom relatively greater than the tension applied to the boom by the first lower cable when the boom is in the first position; and, the first line, first lower cable and the actuator apply a tension to the boom relatively greater than the tension applied to the boom by the second lower cable when the boom is in the second position.

17. A pipe handling device comprising:

a frame;

a boom pivotally connected to the frame, the boom movable between a first generally horizontal position and a second generally vertically position;

an arm extending outwardly of the boom when the boom is in the second position, the arm having a gripper at an end thereof opposite the boom;

a first line having a first end connected to the boom, and an opposite end connected to a connector;

a first lower cable having a first end connected to the frame, and an opposite second end connected to the connector;

a second lower cable having a first end connected to the frame, and an opposite second end connected to the connector;

an actuator having a first end connected to the frame, and an opposite second end connected to the connector;

the first line and second lower cable applying tension to the boom when the boom is in the first position; and, the first line, first lower cable and actuator applying tension to the boom when the boom is in the second position.

18. A pipe handling device comprising:

a frame;

a boom pivotally connected to the frame, the boom movable between a first generally horizontal position and a second generally vertically position;

an arm extending outwardly of the boom when the boom is in the second position, the arm having a gripper at an end thereof opposite the boom;

a first line having a first end connected to the boom, and an opposite end connected to a connector;

a first lower cable having a first end connected to the frame, and an opposite second end connected to the connector;

a second lower cable having a first end connected to the frame, and an opposite second end connected to the connector; and, an actuator having a first end connected to the frame, and an opposite second end connected to the connector, with the actuator being controllable to alter an angular relationship between the first line and the first lower cable to increase or decrease the tension on the boom when the boom is in the second position.

* * * * *